US007967324B2

(12) United States Patent
Miette et al.

(10) Patent No.: US 7,967,324 B2
(45) Date of Patent: Jun. 28, 2011

(54) CROSS-COUNTRY SKI ASSEMBLY AND CROSS-COUNTRY SKI BINDING

(75) Inventors: Philippe Miette, Annecy le Vieux (FR); François Girard, Veyrier du Lac (FR); Eddy Yelovina, Seynod (FR)

(73) Assignee: Salomon S.A.S., Metz-Tessy (FR)

( * ) Notice: Subject to any disclaimer, the term of this patent is extended or adjusted under 35 U.S.C. 154(b) by 383 days.

(21) Appl. No.: 11/639,289

(22) Filed: Dec. 15, 2006

(65) Prior Publication Data

US 2007/0138765 A1 Jun. 21, 2007

(30) Foreign Application Priority Data

Dec. 16, 2005 (FR) ..... 05 12831
Mar. 17, 2006 (FR) ..... 06 02421

(51) Int. Cl.
*A63C 9/18* (2006.01)

(52) U.S. Cl. ..... 280/618; 280/607; 280/620

(58) Field of Classification Search ..... 280/607, 280/615, 618, 11.14, 620
See application file for complete search history.

(56) References Cited

U.S. PATENT DOCUMENTS 5,052,710 A 10/1991 Provence et al.
5,092,620 A 3/1992 Girault et al.
5,114,182 A 5/1992 Rousset et al.
5,338,053 A 8/1994 Hauglin
5,664,797 A * 9/1997 Haughlin ..... 280/615
5,671,941 A 9/1997 Girard
5,741,023 A * 4/1998 Schiele et al. ..... 280/607
5,794,963 A 8/1998 Girard
5,924,719 A 7/1999 Girard
5,957,478 A 9/1999 Vigny
6,017,050 A 1/2000 Girard
6,027,135 A 2/2000 Hauglin
6,209,903 B1 4/2001 Girard
6,289,610 B1 9/2001 Girard et al.
6,315,318 B1 * 11/2001 Caron et al. ..... 280/617
6,374,517 B2 4/2002 Girard
6,435,537 B2 8/2002 Veux
6,644,683 B1 11/2003 Hauglin
6,811,177 B2 11/2004 Lancon et al.
6,964,428 B2 11/2005 Quellais et al.
6,986,526 B2 1/2006 Haughlin
7,097,194 B2 8/2006 Kogler (Continued)

FOREIGN PATENT DOCUMENTS

DE 297 24 094 U1 1/2000

(Continued)

OTHER PUBLICATIONS

U.S. Appl. No. 11/692,419, filed Mar. 28, 2007, Philippe Miette.

(Continued)

*Primary Examiner* — Jeffrey J Restifo
(74) *Attorney, Agent, or Firm* — Greenblum & Bernstein, P.L.C.

(57) ABSTRACT

A binding device for a ski or other sports apparatus. The ski or sports apparatus provides an upper service adapted to receive a binding device for retaining a boot, the binding device including an anchoring mechanism to anchor the binding device to the ski, the anchoring mechanism including a slide and at least one tightening mechanism which enables the binding device to be forced in place against the upper surface of the ski or sports apparatus.

60 Claims, 15 Drawing Sheets

U.S. PATENT DOCUMENTS

| | | | | |
|---|---|---|---|---|
| 7,111,865 | B2 | 9/2006 | Girard | |
| 7,159,891 | B1 * | 1/2007 | Niggemann | 280/607 |
| 7,296,818 | B2 * | 11/2007 | Krumbeck et al. | 280/607 |
| 7,300,069 | B2 * | 11/2007 | Schretter | 280/607 |
| 7,344,149 | B2 * | 3/2008 | Leitner | 280/607 |
| 2002/0105168 | A1 | 8/2002 | Lancon | |
| 2002/0130490 | A1 * | 9/2002 | Billon et al. | 280/618 |
| 2004/0056449 | A1 | 3/2004 | Girard et al. | |
| 2004/0056451 | A1 * | 3/2004 | Baikhardt | 280/618 |
| 2005/0116444 | A1 | 6/2005 | Himmetsberger et al. | |
| 2005/0212259 | A1 | 9/2005 | Leitner | |
| 2006/0012152 | A1 | 1/2006 | Quellais et al. | |
| 2006/0145452 | A1 | 7/2006 | Bjertnaes | |
| 2006/0145453 | A1 * | 7/2006 | Pollmann | 280/607 |
| 2006/0163844 | A1 * | 7/2006 | Baumgartner et al. | 280/607 |
| 2006/0163845 | A1 * | 7/2006 | Baumgartner et al. | 280/607 |
| 2007/0205582 | A1 * | 9/2007 | Himmetsberger et al. | 280/609 |
| 2007/0205583 | A1 * | 9/2007 | Schary et al. | 280/609 |
| 2007/0228695 | A1 * | 10/2007 | Miette | 280/615 |
| 2007/0273127 | A1 * | 11/2007 | Girard et al. | 280/607 |

FOREIGN PATENT DOCUMENTS

| | | | |
|---|---|---|---|
| DE | 10 2004 018 296 | A1 | 2/2005 |
| DE | 20 2005 002 010 | U1 | 6/2005 |
| DE | 10 2004 024 881 | A1 | 7/2005 |
| EP | 0 383 104 | A2 | 8/1990 |
| EP | 0 551 899 | A1 | 7/1993 |
| EP | 0 679 415 | A1 | 11/1995 |
| EP | 0 768 103 | A1 | 4/1997 |
| EP | 0 878 218 | A2 | 11/1998 |
| EP | 0 904 139 | B1 | 11/1998 |
| EP | 0 904 139 | B1 | 3/1999 |
| EP | 0 913 102 | A1 | 5/1999 |
| EP | 0 913 103 | A1 | 5/1999 |
| EP | 1 062 991 | A2 | 12/2000 |
| EP | 1 440 713 | A1 | 7/2004 |
| FR | 2 638 974 | A1 | 5/1990 |
| FR | 2 638-974 | A1 | 5/1990 |
| FR | 2 641 196 | A1 | 7/1990 |
| FR | 2 645 764 | A1 | 10/1990 |
| FR | 2 733 159 | A1 | 10/1996 |
| FR | 2 736 842 | A1 | 1/1997 |
| FR | 2 738 158 | A1 | 3/1997 |
| FR | 2 742 060 | A1 | 6/1997 |
| FR | 2 776 200 | A1 | 9/1999 |
| FR | 2 834 473 | A1 | 7/2003 |
| FR | 2 843 310 | A1 | 2/2004 |
| FR | 2 853 253 | A1 | 10/2004 |
| FR | 2 856 312 | A1 | 12/2004 |
| WO | WO-88/04563 | A1 | 6/1988 |
| WO | WO-98/37933 | A1 | 9/1998 |
| WO | WO-00/04965 | A1 | 2/2000 |
| WO | WO-01/93963 | A1 | 12/2001 |
| WO | WO-03/002217 | A1 | 1/2003 |
| WO | WO-03/002217 | A2 | 1/2003 |
| WO | WO-03/084620 | A1 | 10/2003 |
| WO | WO-2004/045728 | A2 | 6/2004 |
| WO | WO-2006/072812 | A1 | 7/2006 |

OTHER PUBLICATIONS

U.S. Appl. No. 29/277,934, filed Mar. 14, 2007, François Girard.
U.S. Appl. No. 11/639,289, filed Dec. 15, 2006, Philippe Miette et al.
U.S. Appl. No. 29/277,934, filed Mar. 14, 2007, François Girard et al.

* cited by examiner

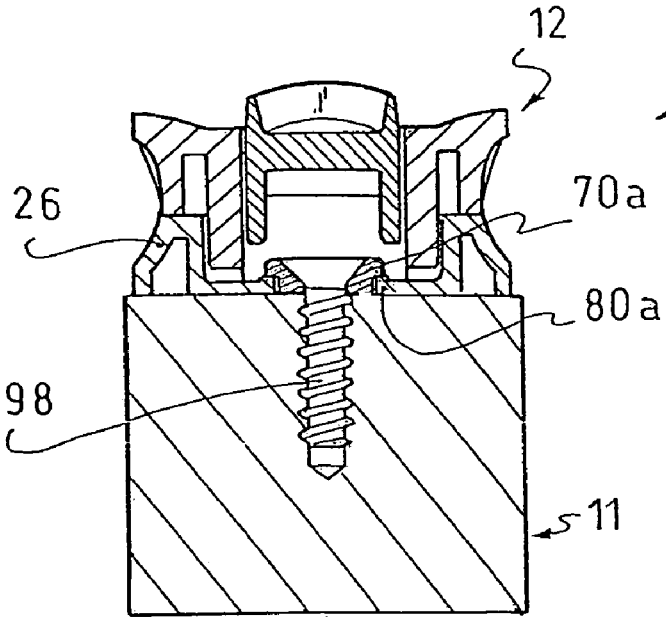
Fig:23
Fig:24
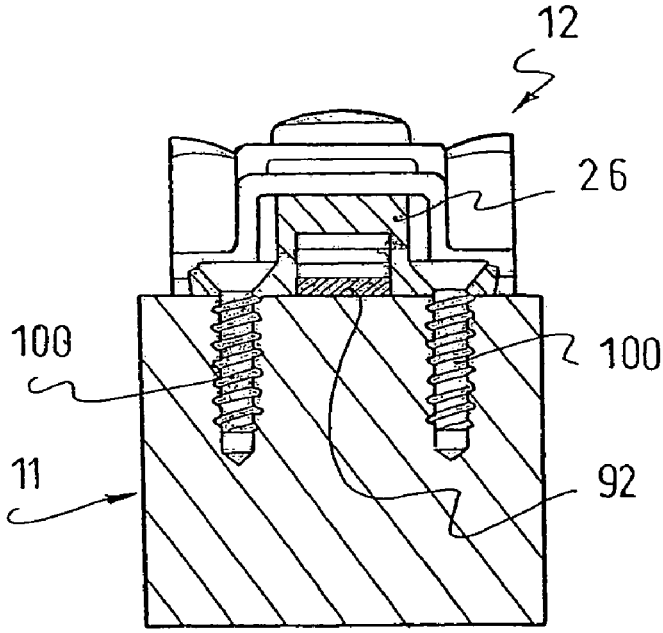

CROSS-COUNTRY SKI ASSEMBLY AND CROSS-COUNTRY SKI BINDING

CROSS-REFERENCE TO RELATED APPLICATIONS

This application claims priority under 35 U.S.C. §119 of French Patent Application No. 05/512831, filed on Dec. 16, 2005, and French Patent Application No. 06/02421, filed on Mar. 17, 2006, the disclosures of which are hereby incorporated by reference thereto in their entireties.

BACKGROUND OF THE INVENTION

1. Field of the Invention

The invention relates to the field of cross-country ski bindings and to skis provided with at least one device for binding an article of footwear to the ski. In addition, the invention relates to devices for binding the front end region of an article of footwear to a sports apparatus, such as a cross-country ski, and to assemblies of such apparatus and binding devices.

2. Description of Background and Relevant Information

In many cross-country ski bindings, or ski binding devices, the connecting mechanism of the boot is in the form of a connector, such as a connecting rod or pin, adapted to be held in a latch or jaw associated with the ski. Examples of such mechanisms are disclosed in the following patent documents: FR-2638974, U.S. Pat. No. 5,052,710, FR-2645764, U.S. Pat. No. 5,092,620, FR-2834473, U.S. Pat. No. 6,811,177, FR-2742060, FR-2856312, U.S. Pat. No. 7,111,865, FR-2738158, U.S. Pat. No. 5,794,963, EP-551899, U.S. Pat. No. 5,338,053, EP-904139, and U.S. Pat. No. 6,027,135.

In other devices, the boot-connecting mechanism is made in two parts, i.e., either two parallel connectors, i.e., rods or pins (EP-679415, U.S. Pat. No. 5,671,941, FR-2853253, FR-2843310, US-2004/0056449, WO-01/93963, U.S. Pat. No. 6,986,526), or a front stop and a rear engagement element (FR-2776200, U.S. Pat. No. 6,435,537, FR-2733159, U.S. Pat. No. 5,957,478, EP-1100601, WO-00/04965, U.S. Pat. No. 6,644,683, DE-102004018296).

Other devices are disclosed in the patent documents EP-1492598, WO-03/084620, and U.S. Pat. No. 7,097,194, for example.

Various arrangements are known for securing such binding devices onto a cross-country ski. In numerous cases, the anchoring is simply provided by screws, which make it possible to fix the device directly to the ski. In other cases, the binding device is directly glued or welded to the ski, or even elastically nested onto the ski.

The patent document WO-88/04563 proposes a binding device for cross-country skis, which device is mounted on an interface element integrated with the ski. The interface element is provided with a longitudinal guide plate in which the binding device can slide. The binding device has a specific arrangement for blocking its longitudinal position with respect to the interface element. This arrangement includes a vertical screw, which penetrates the ski at the front, on the one hand, and a toothed wheel with a cam cooperating with a lateral rack, on the other hand. The blocking arrangement described in WO-88/04563, therefore, provides for the blocking of the device in any one of a plurality of predefined discrete positions.

The patent document WO-03/002217 discloses a binding device mounted to an interface element which is in the form of a plate covering the upper surface of the ski. The interface plate is screwed onto the ski and the binding device is mounted to the interface plate with no direct contact between the binding device and the ski.

The patent documents WO-2004/045728, US-2006/0145452, and DE-U-202005002010 disclose an interface plate adapted to be glued or welded to the ski. The edges of the plate form a guide onto which the body of the binding device can be slidably engaged.

The patent document DE-102004024881 discloses a binding device mounted on an interface element and having toothed rockers, which are part of the base of the binding and are provided to cooperate with corresponding racks formed on the interface element. This mechanism, like that of the aforementioned patent document WO-88/04563, ensures that the binding device is blocked in one of several predetermined discreet positions without providing for a tightening mechanism.

The patent document DE-U-29724094 discloses an assembly in which a central rail is fixed on the upper surface of a ski. A base, to which a binding device can be secured, has on its lower surface a profile that is complementary to the rail so as to be slidably engaged on the rail. A longitudinal blocking mechanism is provided to ensure the binding device is completely anchored to the ski. This document does not describe any tightening mechanism.

The prior art, according to which the binding devices are screwed directly in a ski, offer greater possibilities for mounting/dismounting the assembly, as well as possibilities for adjusting the longitudinal position on the ski. However, they have drawbacks such as adding weight to the assembly, increasing the binding device relative to the ski, and/or preventing the skier's forces from being directly transmitted to the ski, as well as many factors that negatively affect the performance of the assembly. Furthermore, they all have the same drawback of allowing operational clearances between the binding device and the ski, which negatively affect the precise steering of the ski. Some prior art devices have actually shown that, as the longitudinal locking mechanisms have no retaining/guiding function, the binding device could separate from its interface in the case of a substantial force, such as during a fall.

SUMMARY OF THE INVENTION

The invention provides a new ski binding assembly, which makes it possible to achieve a better compromise among all of these components, one not characterized by the foregoing advantages.

To this end, the invention is proposes a ski binding assembly for a ski with an upper surface adapted to receive a binding device provided to retain a boot on the ski, of the type in which the binding assembly has a device that anchors the binding device to the ski, the anchoring device having a slide and at least one tightening mechanism that presses the binding device against the upper surface of the ski.

According to other characteristics of the invention, the slide is transversely arranged at the center of the ski, and its width is narrower than that of the ski, so that the ski support area is transversely arranged on both sides of the central slide, i.e., the lower part of the binding device, when anchored to the ski, transversely straddles the slide.

BRIEF DESCRIPTION OF DRAWINGS

Other characteristics and advantages of the invention will be better understood from the detailed description that follows, with reference to the annexed drawings, in which:

FIGS. 23 and 24 are cross-sectional views along the lines XXIII-XXIII and XXIV-XXIV, respectively, of FIG. 22.

DETAILED DESCRIPTION OF THE INVENTION

Three exemplary embodiments of an assembly 10 according to the invention are more particularly described hereinbelow, such assemblies including, in these exemplary cases, cross-country ski binding devices 12 that retain the front end of a cross-country ski boot, the rear end of the boot remaining free to be raised and lowered.

Figure 2:
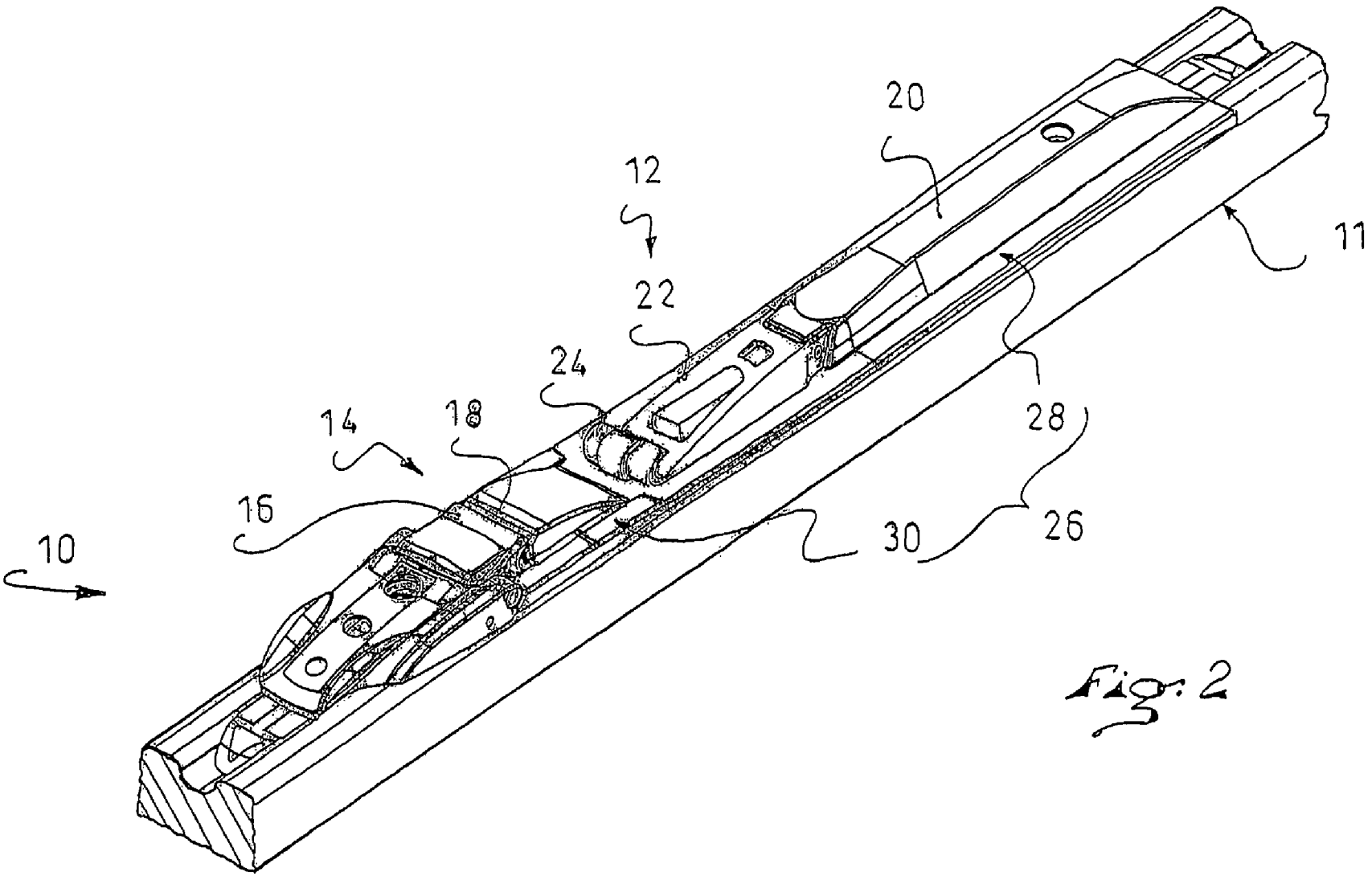
FIG. 2 is a perspective view of the assembly of FIG. 1, when in use.

In the examples shown, such as in FIG. 2, for example, the binding device 12 is adapted to ensure the binding of a cross-country ski boot having two-part connectors. The boot (not shown in the drawings), has, for this purpose, two connectors, such as rods or pins or other structural elements, arranged in the boot sole so as to be flush beneath the latter, or substantially flush. Boots provided with this type of connector are disclosed in the patent documents EP-913102 and EP-913103, as well as in U.S. Pat. No. 6,289,610 and U.S. Pat. No. 6,374,517, the disclosures of the latter two documents being hereby incorporated by reference thereto in their entireties. Reference will be made to these documents hereinafter. Therefore, these connectors are, for example, two cylindrical connectors extending across a longitudinal groove provided in the lower surface of the sole of the boot. The front connector is arranged, for example, in the vicinity of the front end of the sole, and the rear connector is rearwardly offset by a predetermined distance, so as to be arranged in the area of, or forward of, a zone of the boot corresponding to the metatarsophalangeal zone of the user's foot. This arrangement of the connecting zones is particularly advantageous in cross-country skiing because it enables the skier, when using a boot having a flexible sole, to maintain a flexing of the boot that corresponds to the flexing of the foot. However, the invention could also be implemented with connectors having a different structure or configuration, such as, for example, connectors with a non-circular cross-section, hooks, anchoring members formed directly with the material of the sole, such as grooves formed therewithin or projections extending therefrom.

In a known manner, the front connector is adapted to cooperate with a locking mechanism 14 having a movable hook-shaped jaw 16 and a transverse edge 18 forming an immovable jaw for locking the boot onto the sports apparatus, or ski. Once locked in the locking mechanism, the front connector can freely pivot inside the jaw, thus allowing for an articulated binding of the front end of the boot. This functioning principle of a locking mechanism, such as mechanism 14, is well known from the prior art (such as, for example, that of the products sold by Salomon under the trade name "SNS Pilot") and, therefore, the principle has not been described in greater detail, although the present invention can be implemented with other types of locking mechanisms.

The rear connector is adapted to enable the boot to connect to an elastic return mechanism integrated into a guiding member or rib 20 of the device. Such an elastic return mechanism is described, for example, in the patent documents EP-768103 and U.S. Pat. No. 6,017,050, both commonly owned herewith, the disclosure of the latter of which is hereby incorporated by reference thereto in its entirety. It includes a connecting member 22 having a hook-shaped front end 24 (adapted to latch onto the rear connector of the boot), and a rear end connected to the base so as to be capable of longitudinally sliding and pivoting about a transverse axis. An elastic return mechanism (not shown) biases the connecting member 22 back to the resting position shown in FIG. 2. In view of this construction, when the boot heel is lifted up by pivoting the boot around its front connector, the connecting member 22, latched onto the rear connector of the boot, can follow the upward and forward displacement of the rear connector while exerting on the latter a return force that tends to bring the boot sole back toward and/or to the upper surface of the ski 11.

The invention can also be implemented for other binding devices, for example, for a binding device of the type described in the patent documents EP-1440713 and U.S. Pat. No. 6,964,428, the disclosure of the latter of which is hereby incorporated by reference thereto in its entirety, or any of the binding devices described in the documents mentioned in the background, above. Thus, the invention can be easily implemented with a device having, at the front, an elastic buffer against which the front end of the boot can become engaged when the heel is lifted, as, for example, in the mechanisms sold by Salomon S. A. under the trade name "SNS Profil". In the latter case, the boot can be provided with only one connector.

In any case, the binding device 12 of the assembly 10 has a base (or main body) 26, which can be made in one or several parts, and on which, for example, a locking mechanism and an elastic return mechanism (such as, e.g., a mere elastic buffer) are mounted. In the example shown, the base 26 has a rear portion 28 (which also forms the rear portion of the guiding rib 20, the rib projecting from the upper surface of the ski) and a front portion 30, which bears the locking and elastic return mechanisms. The main body overall has a substantially plate-shaped lower portion extending over the length of the binding device and over a width close to the conventional width of the ski onto which it is to be anchored. As can be seen, this lower, plate-shaped, portion defines, on each side of the guiding rib 20, lateral boot support surfaces onto which the boot is adapted to take support when the skier exerts a downward force. In cross-country skiing, while using the conventional technique or the skating technique, such a phase occurs especially when the skier thrusts himself/herself forward while being supported on the ski.

In the first embodiment shown in FIGS. 1 to 10, the assembly 10 is secured to a cross-country ski 11 (only the central portion of which is shown), whose upper surface has a non-planar shape. In this case, the upper surface 32 has a central recess 34, which longitudinally extends over a substantial portion of the length of the ski 11. More particularly, this recess 34 extends in the central area of the ski, which is adapted to receive a binding device. In this case, the recess has a cross section, substantially shaped as a vertical, upwardly open U. In a cross-sectional view, the recess 34 is transversely framed on each side by lateral portions 36 of the ski upper surface, which lateral portions are arranged in an area located above the level of the ski upper surface within the recess 34. Each one of the lateral portions 36 is connected to the recess 34 by a rounded edge, and is connected to one of the side surfaces 38 of the ski by another rounded edge, but each of them has a substantially planar portion, between the two rounded edges.

In the example shown, the ski recess 34 has a particular shape created directly during the manufacture of the ski, due to which the upper ski layer (for example having—inside out—a resin-coated fiber reinforcement layer, a decorative layer, and an outer protective layer) extending at the bottom of the recess 34 as well as in the lateral portions 36 of the upper ski surface 32.

According to the invention, the binding assembly 10 further includes a central slide 40 for anchoring the binding device 12 to the ski.

In the first exemplary embodiment of the invention, the central slide 40 is in the form of a longitudinal element adapted to be received and fixed within the ski recess 34. In the example shown, the slide 40 is fixed in the recess by having been glued or welded thereto. In this case, it is advantageous for the slide to have a lower contact surface 42 that is complementary to the upper surface of the ski in the recess 34, in order to provide a maximum contact surface. However, in an alternative configuration, the slide 40 could be fixed to the ski 11 by screws, in which case the lower surface 42 of the slide 40 could have a configuration different from that of the recess 34, provided that a precise and stable positioning of the slide 40 with respect to the ski can be ensured. Other alternative embodiments could provide for the slide to be fixed to the ski by binding elements which would have been previously implanted in the ski, for example during manufacture of the ski. Such implanted elements could be connected, for example, to the core or only to the upper surface of the ski. The slide could also be directly integrated into the ski during the manufacture of the ski. However, the slide could be more easily fixed against the outer layer of the upper surface of the ski during or after the manufacture of the ski.

The slide 40 has a hollow groove 44, which extends longitudinally and opens out upwardly onto an upper surface 46 of the slide, and which has a cross-sectional profile with a lower portion and an upper portion. The lower portion of the groove 44 has a maximum transverse width greater than that of the upper portion, the latter opening out onto the upper surface 46. The lower portion has a substantially semi-circular profile, whereas the upper portion is a mere groove with parallel vertical walls. In a transverse cross-section, the groove 44 has a general shape similar to that of a reverse key hole. The slide 40 is entirely received within the recess 34, so that its width and height are smaller than the corresponding dimensions of the recess 34. Therefore, the slide 40 has a smaller width than that of the ski in the longitudinal central zone of the latter. In practice, the slide can thus have a width ranging from 10 to 25 mm, for a height ranging from 8 to 20 mm.

In the example shown, the transverse cross section of the recess 34 has a constant profile over the entire length of the central zone in which the slide is to be implanted. This way, in a particular exemplary embodiment, the lower surface 42 of the slide 40, as well as the groove 44, can also have a constant profile over the entire length of the slide. In this case, it is possible to provide for the slide to be made in the form of an element made by extrusion, thereby having a uniform cross-sectional dimension along a length of such element, the element having been cut to a desired length, which is a particularly advantageous manufacturing method in terms of cost. However, the slide 40 could alternatively be made by molding or by any other appropriate manufacturing method.

In the embodiment shown, the slide 40, which is an element made by extrusion or at least in the form of an element with an extruded profile, with finishing end pieces 48 provided at each end of the slide.

To ensure its anchoring on the ski, the binding device 12 has anchoring elements 50, 52, 54, 56 adapted to cooperate with the slide 40.

In the example shown, each of these anchoring elements comprises a rail element adapted to be slidably engaged inside the groove 44 of the slide by being generally immobilized in all directions except in longitudinal translation. In this example, the rail elements have, in transverse cross section, the same profile as that of the groove 44. They could have a different profile so as to be in contact with only certain portions of the walls defining the groove. In the example shown, the length of the rail elements ranges from 20 mm to 30 mm, or substantially 20 mm to substantially 30 mm.

Each rail element is connected to at least one element of the binding device.

In the example shown, there are four distinct rail elements 50, 52, 54, 56, each connected to a certain one of the parts of the base.

Figure 5:
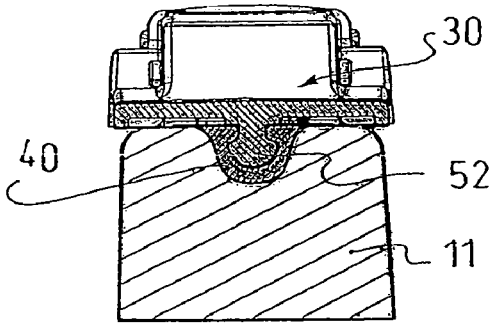
FIGS. 5 to 7 are cross-sectional views along the lines V-V, VI-VI, and VII-VII of FIG. 3.

In FIG. 5, one of the rail elements 52 is shown to be an extension of the front part 30 of the binding base 26, more precisely of a substantially flat lower portion of the front part 30. The rail element 52, made here in one piece with the base, could be made as an attached piece fixed by any known expedient (such as, e.g., by gluing, welding, nesting, or by being attached by means of screws).

Figure 6:
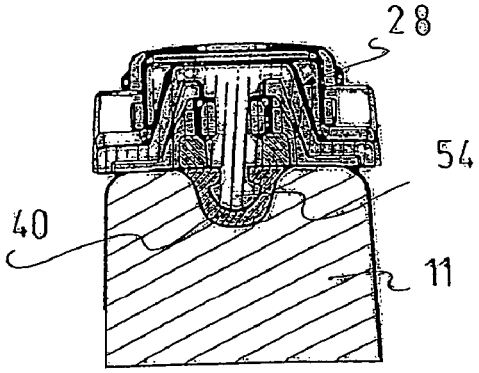

FIG. 6 shows a rail element 54 made in one piece with the lower end of a supporting foot of the rear portion 28 of the base. In these two cases, the rail element is therefore fixed with respect to the binding device.

Figure 1:
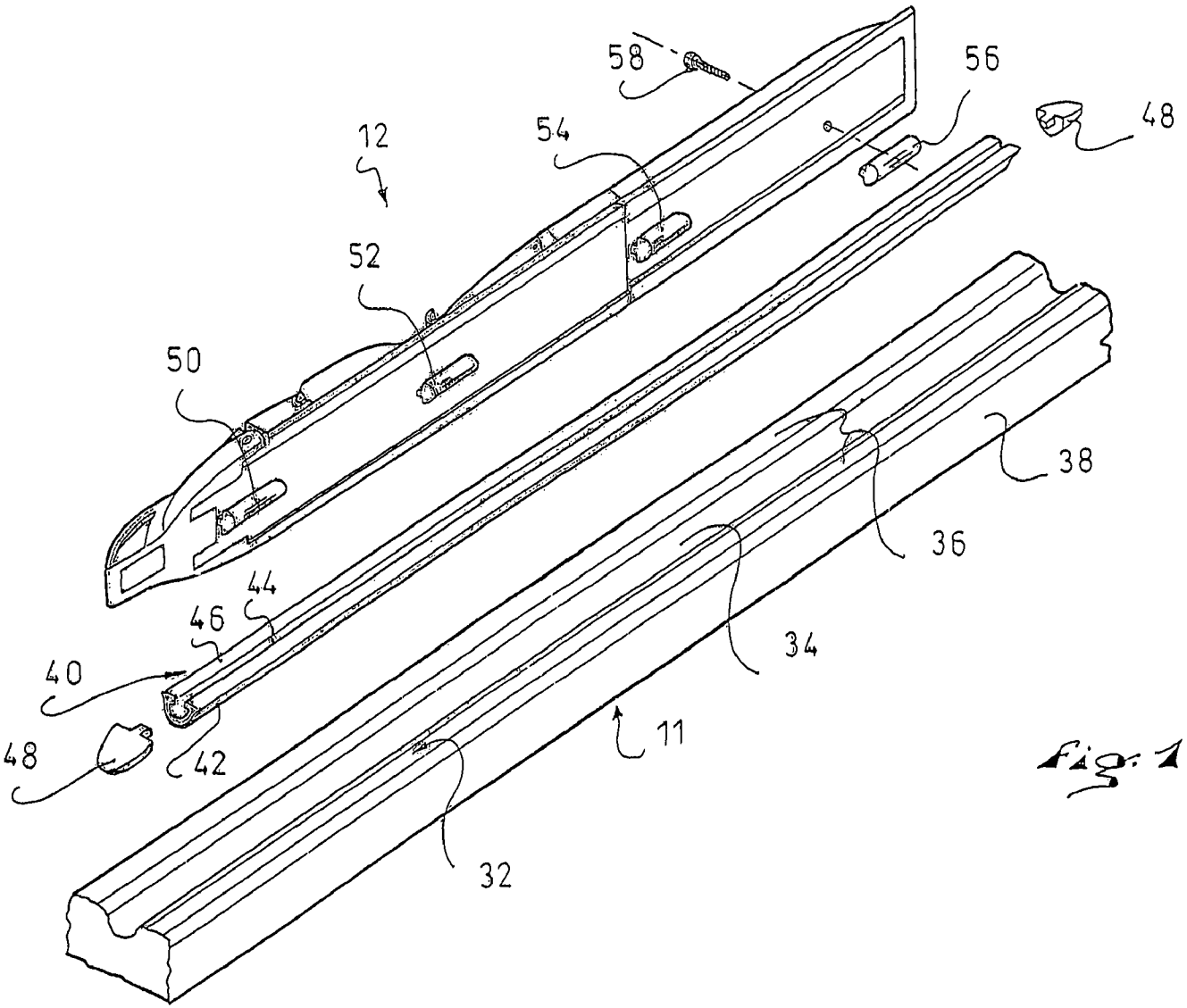
FIG. 1 is an exploded perspective schematic view of a first embodiment of a ski binding assembly according to the invention.
Figure 3:
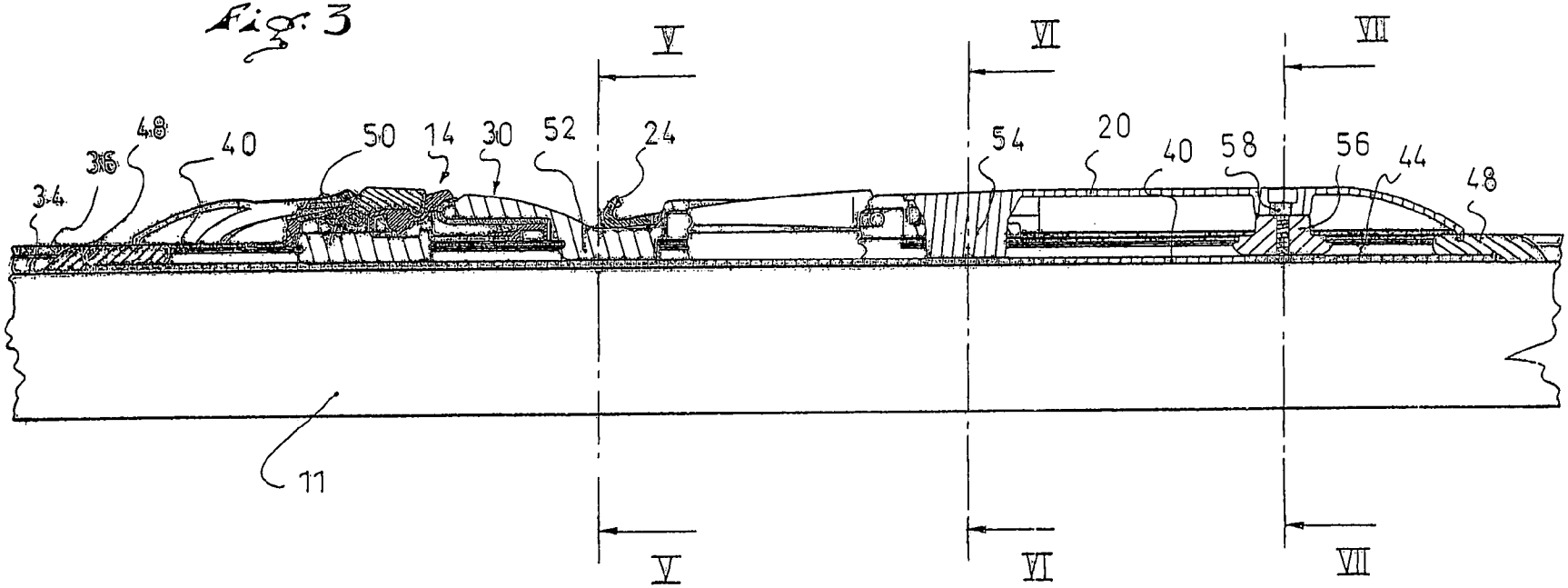
FIG. 3 is a partial, longitudinal cross-sectional, schematic view of the assembly of FIG. 2.
Figure 4:
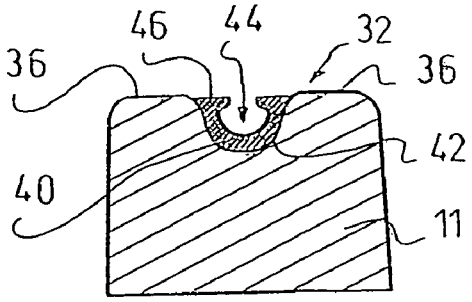
FIG. 4 is a transverse, cross-sectional view of the ski provided with the slide, before the binding device is mounted.
Figure 7:
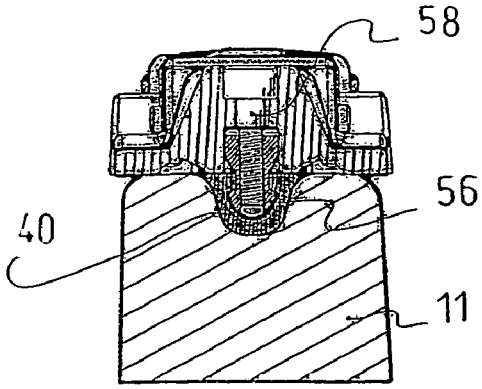

On the contrary, as seen in FIGS. 1, 3, and 7, the rear rail element 56 is not fixed with respect to the binding device 12. The rear rail element 56 is provided in the form of a nut, whereas the rear part 28 of the base 26 receives a screw 58 having a vertical axis, the upper head of the screw applying a vertical, downward force against the lower surface of a housing of the base 26. The screw 58 extends to this lower surface through an appropriate opening and the lower end portion of the screw 58 is threaded within the nut portion of the rear rail element 56 to form a downward tightening mechanism of the binding device. When engaged in the groove 44 of the slide 40, the rail element 56 cannot move either vertically upward, nor rotationally. In this way, threaded engagement of the screw 58 in the nut portion of the rail element 56 causes a downward vertical movement of the screw 58, the head of which drives the base 26 along.

According to an aspect of the invention, the binding assembly 10 is designed so that the binding device 12 is tightly supported against the upper surface 32 of the ski. Moreover, as shown in exemplary drawings, the lower part of the binding device is supported directly against the upper surface of the ski. This characteristic ensures that there is no vertical play between the binding device 12 and the ski 11, so that any interfering movement during use of the ski is avoided. Accordingly, the tightening mechanism, in the form of the screw 58 and the rail element 56 comprise a blocking arrangement so that the binding device 12 is blocked in position longitudinally along the length of the ski.

Figure 8:
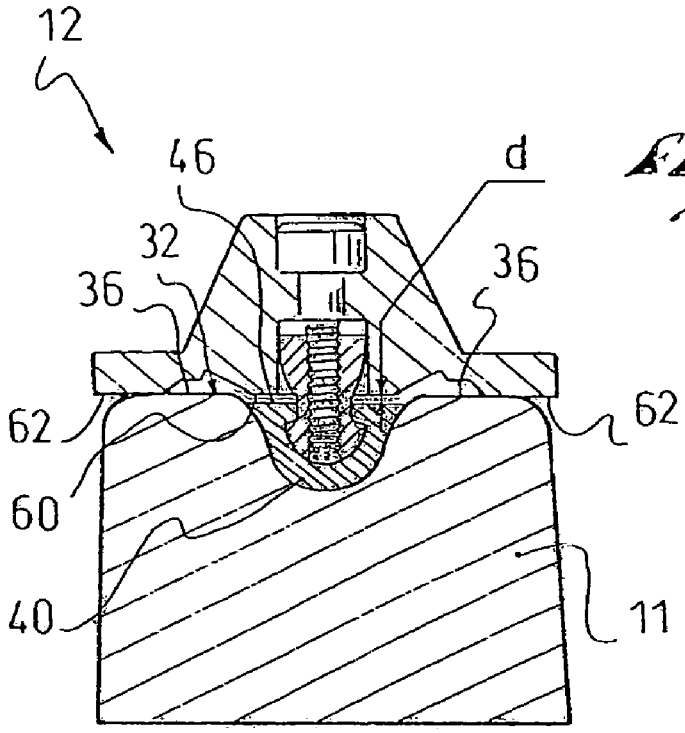
FIGS. 8 and 9 are enlarged schematic views showing the effects of the tightening mechanism.
Figure 9:
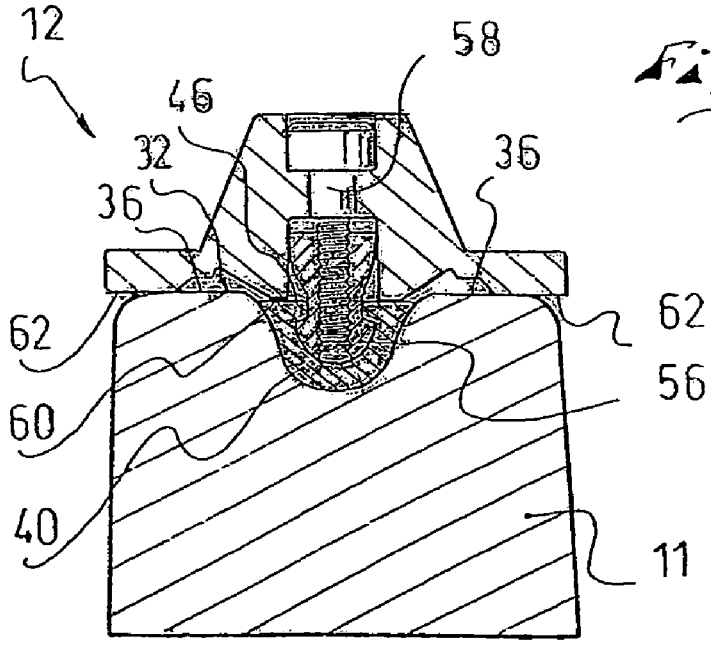

As more precisely shown in the schematic views of FIGS. 8 and 9, the binding assembly 10 is designed in this exemplary embodiment so that, due to the tightening mechanism, the binding device 12 is first supported on the ski 11 and, thereafter, on the slide 40.

In this regard, FIG. 8 shows that the base has a lower surface in which two portions can be seen: a central portion 60 and two lateral portions 62. The opening provided for the screw 58 opens out into the central portion 60 of the base upper surface. The two lateral portions 62 of the lower surface are provided to be substantially arranged opposite the lateral portions 36 of the upper surface 32 of the ski 11.

The upper surface 46 of the slide 40, on the one hand, and the central portion 60 of the base lower surface, on the other hand, are offset height-wise with respect to, respectively, the lateral portions 36 of the ski 11 upper surface, on the one hand, and the lateral portions 62 of the base lower surface on the other hand. These two offsets are calculated so that the base lateral portions 62 are in contact with the lateral portions 36 of the ski upper surface, without the central portion 60 of the base lower surface being supported against the upper surface 46 of the slide 40.

This situation is shown in FIG. 8, where there is an offset "d" between the central portion 60 of the base lower surface and the upper surface 46 of the slide 40. In the example shown, a choice has been made to arrange the upper surface 46 of the slide 40 at a lower level in the area of the lateral portions 36 of the ski upper surface 32. Similarly, the central portion 60 of the base lower surface has been provided to be arranged at a higher level in the area of the lateral portions 62 of this lower surface. These two offsets are limited, in this exemplary embodiment, to tenths of millimeters.

FIG. 9 shows that when the screw 58 is gradually tightened, the tightening action exerted on the binding device by the screw/nut combination (comprised of the screw 58 and rail element 56), the base gradually deforms until the central portion 60 of the base lower surface comes in support against the upper surface 46 of the slide 40.

This deformation is made possible due to the fact that the base material is not extremely rigid, on the one hand, and due to a configuration of the base that allows a controlled deformation of the base, on the other hand, in order to enable the double contact between the base lateral portions and the ski, on the one hand, and the between the base central portion and the slide 40, on the other hand.

By providing that the base first takes support on the ski lateral surfaces 36, there is an optimal contact width between the binding device and the ski. This also guarantees that there is no play between the two elements.

By further providing that the base take support against the slide 40 following the action of the tightening mechanism, the "pulling up" force exerted by the tightening mechanism of the slide 40 is limited.

In the exemplary embodiment shown, only the rear rail element 56 is made in the form of a portion of a tightening mechanism. The other rail elements 50, 52, 54 only ensure a function of guiding and vertically retaining the binding device 12 on the ski 11. However, at least one of these three other rail elements could be made to be associated with a tightening mechanism. In such a case it would be particularly judicious to have the front rail element 50 associated with a tightening mechanism in order to ensure that the binding device 12 optimally lays flat against the ski 11.

In the example shown, four distinct short rail elements are employed. This number and configuration of rail elements reduce friction between the rail elements and the groove 44 of the slide when the device 12 is engaged on the slide 40. Indeed, in the example shown in the drawings, it is necessary to engage one of the front or rear elements through one of the rear or front ends of the groove 44 of the slide 40. The device must then be engaged over the entire length separating the two end rail elements.

Figure 10:
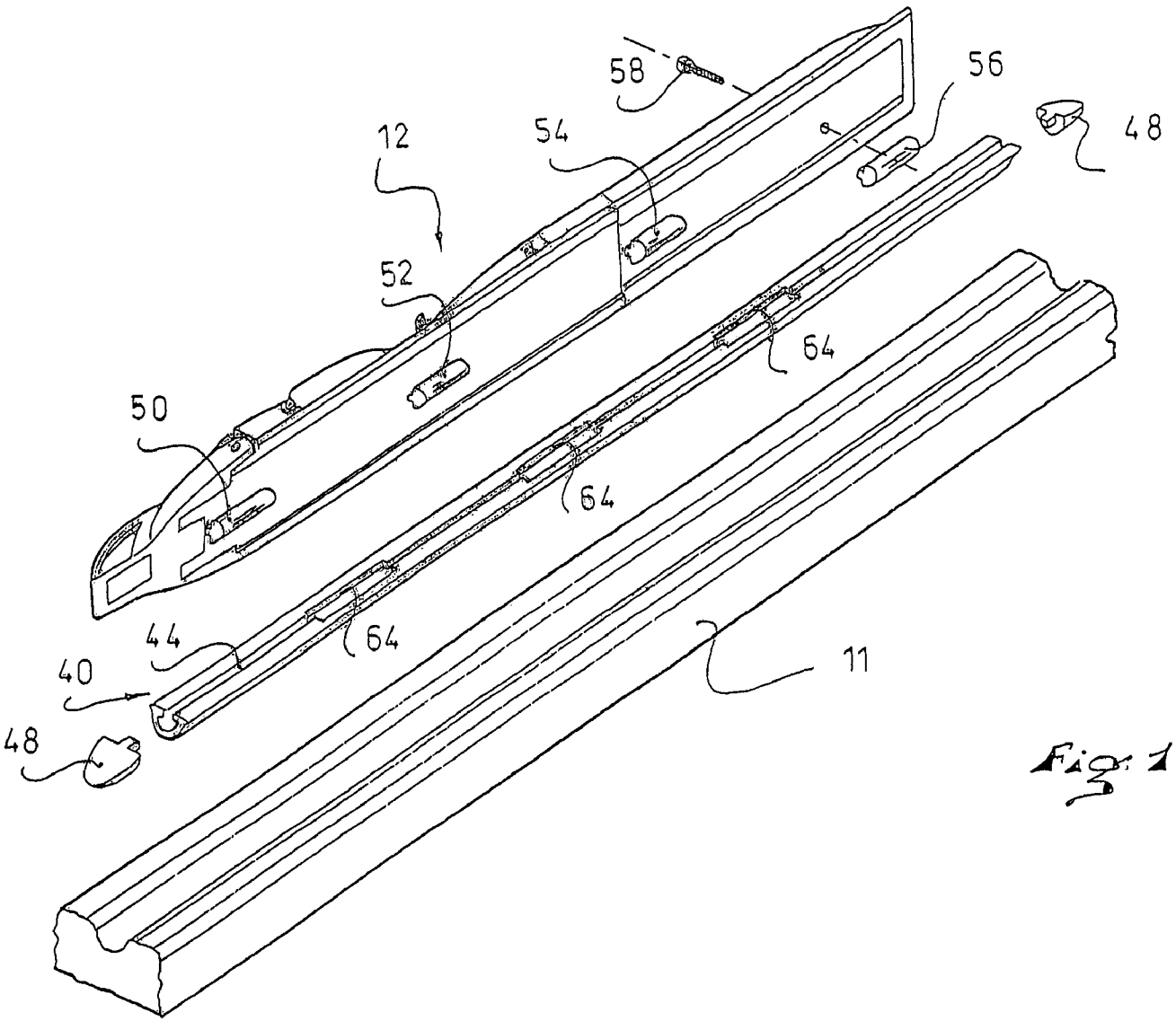
FIG. 10 is a view similar to that of FIG. 1, showing an alternative to the first embodiment according to the invention.
Figure 11:
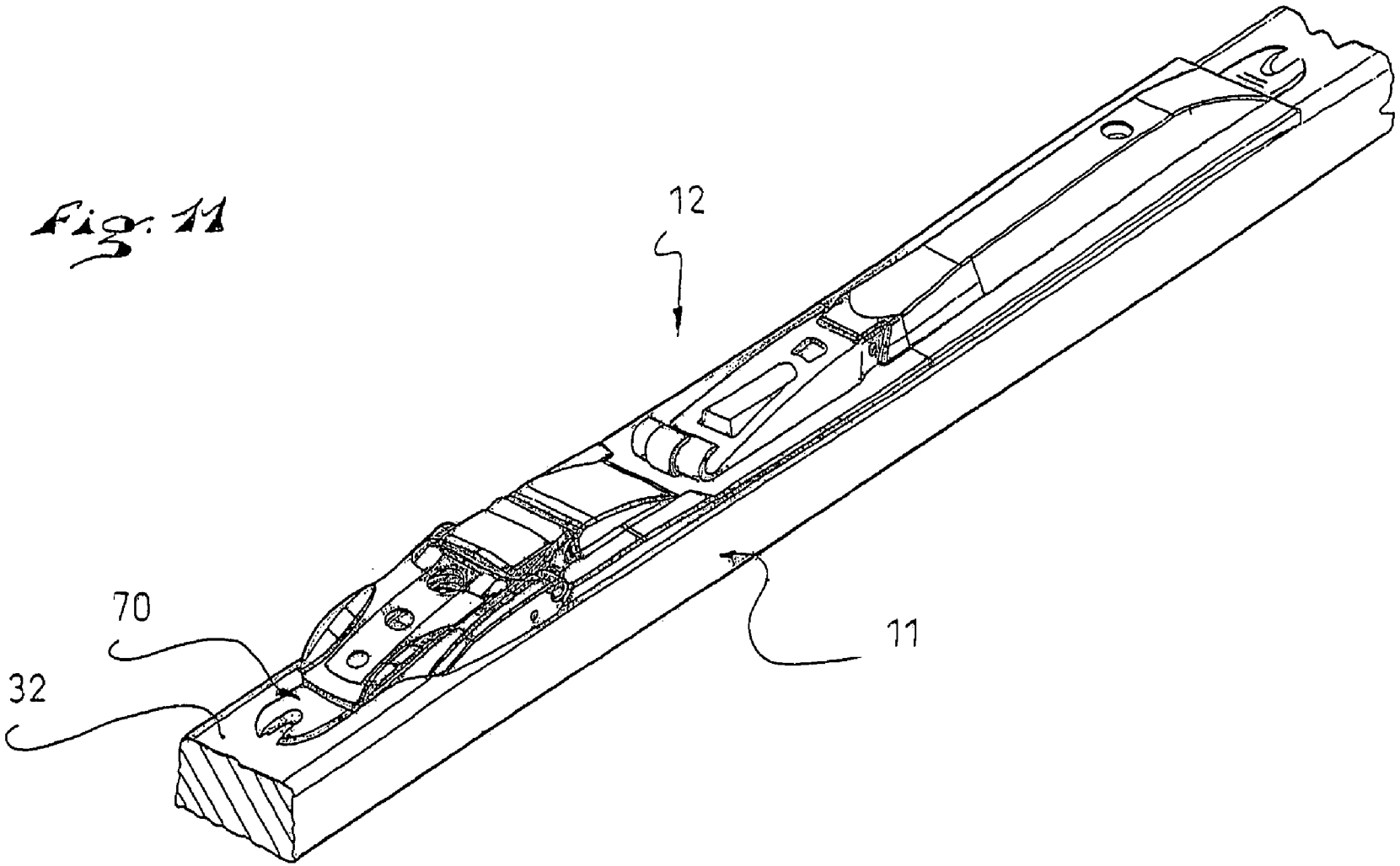
FIG. 11 is a view similar to that of FIG. 2, showing a second embodiment of a ski binding assembly according to the invention.

In an alternative for the first embodiment of the invention shown in FIG. 10, the slide 40 has three windows 64, which make it possible to engage each of the rail elements 50, 52, 54 vertically, and then to offset the device longitudinally in order to engage these rail elements in the non-open portions of the groove 44, so that they are vertically retained therein. The rear rail element 56 can be inserted into the groove 44, for example through a window 64 or through the rear end of the groove 44 (if the latter is open) before the device 12 is engaged on the slide, the screw 58 being screwed into the element 56 only once the device is in place. In the case where the rear end of the slide is open, the tightening mechanism comprised of the screw/nut combination (i.e., the screw 58 and the rear rail element 56) can be pre-mounted on the device and engaged through the open rear end of the groove 44 at the same time the entire device is longitudinally offset forward. This alternative prevents having to slide the device 12 over the entire length of the slide 40, which can pose a problem when the ski has a slight curvature that could deform the slide.

Figure 12:
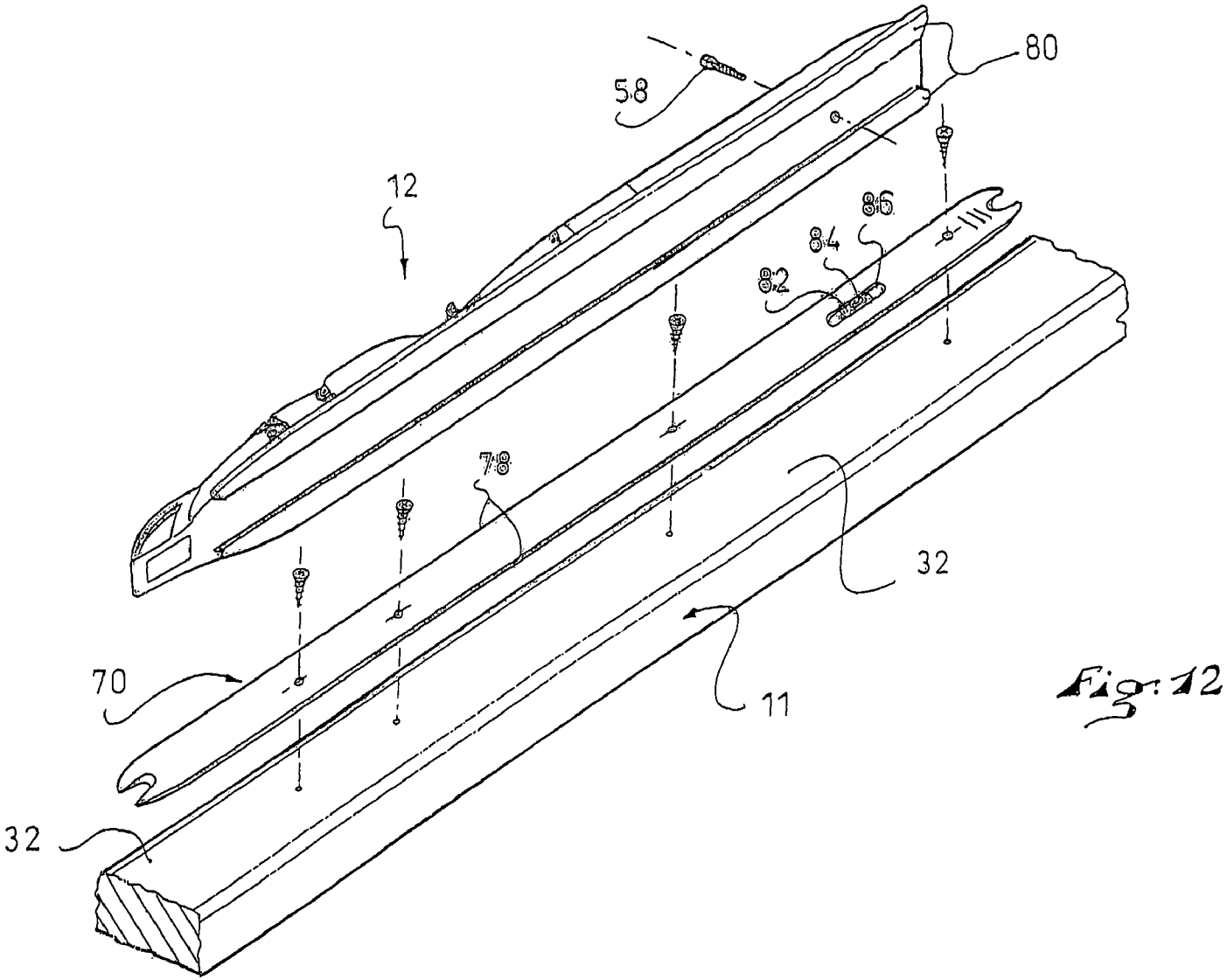
FIGS. 12 to 16 are views similar to those of FIGS. 1 and 3 to 6, respectively, showing the second embodiment of the invention.

A second embodiment of the invention is shown in FIGS. 11 to 20. This second embodiment describes the invention as applied to a binding assembly 10 for a cross-country ski, the upper surface 32 of the ski being flat. As shown in the drawing figures, the binding device 12 is almost identical to that described in reference to the first embodiment, except for the mechanism for anchoring the device onto the ski. Indeed, as shown in FIG. 12, the device is anchored by means of a slide 70 that cannot be integrated into a recess of the ski, since the ski has no recess such as that of the first embodiment. Consequently, the slide 70 has a T-shaped profile. The profile of the slide 70 is more precisely shown in FIG. 14, where it has a lower portion 72, the bottom surface 74 of which is supported on the upper surface 32 of the ski 11. The upper portion 76 of the slide 70 is wider than that of the lower portion 72 so as to overlap transversely outward on both sides of the lower portion 72. Thus, on each side of the slide 70, overhanging edges 78 extend transversely outward with respect to the lateral surfaces of the lower portion 72 of the slide 70, above the ski upper surface.

In this exemplary embodiment, the lower portion 72 has a width about half the ski width in the longitudinal zone of the binding device 12. For a cross-country ski assembly, this lower portion 72 can thus have a width of about 20 mm. The width of the upper portion 76 is several millimeters, for example 5 or 6 mm, greater than that of the lower portion 72, i.e., no greater than about 26 mm in this embodiment. As a result, the overhanging edges 78 measure only a few millimeters, for example 2 or 3 mm. The lower portion 72 and the upper portion 76 each measure, for example, between 2 and 5 mm.

Figure 13:
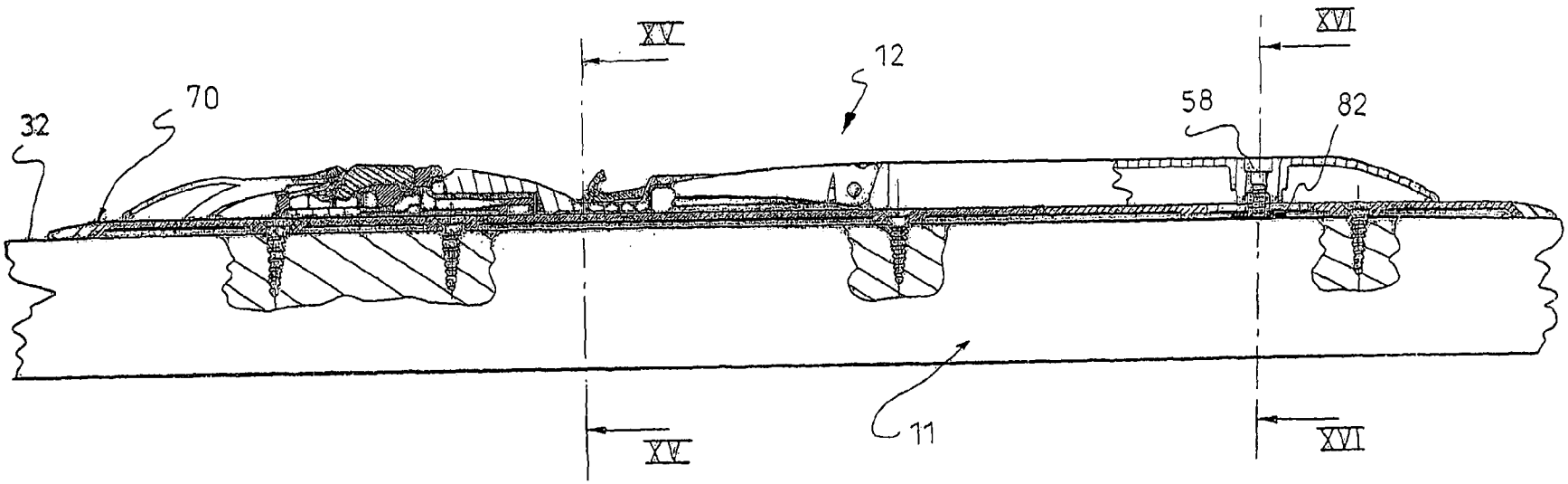
Figure 14:
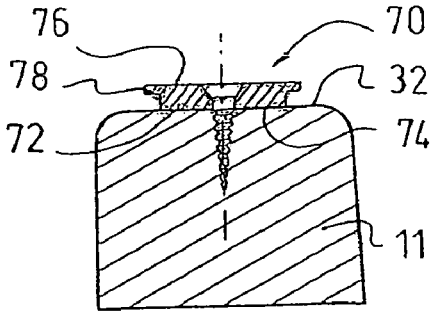

As shown in FIGS. 12 to 14, the slide 70 is adapted to be screwed onto the upper surface 32 of the ski. Other binding mechanisms fall within the scope of the invention, in the same way, for example, as described in the first embodiment. In the example shown, the slide 70 is made by having been molded from a plastic material. Such plastic material can optionally be reinforced with fibers, such as glass fibers. However, other methods of construction are contemplated within the scope of the invention. For example, the slide 70 could be made out of other types of materials, such as metal or composite materials, for example. Similarly, the slide could be made of several parts, the upper and lower parts, for example, being made as two distinct portions. Similarly, the T-shaped profile of the slide could be replaced by a V-shaped profile (dovetail type) or a W-shaped profile, or other shape.

Figure 15:
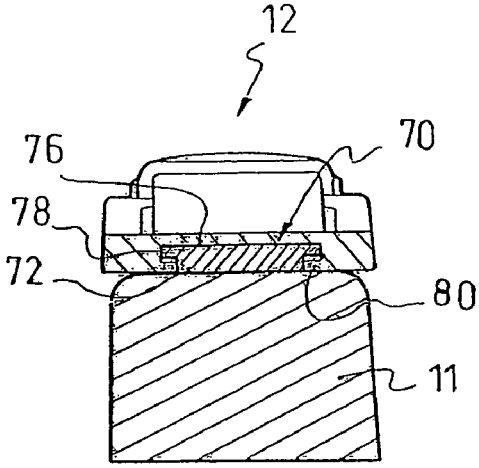
Figure 16:
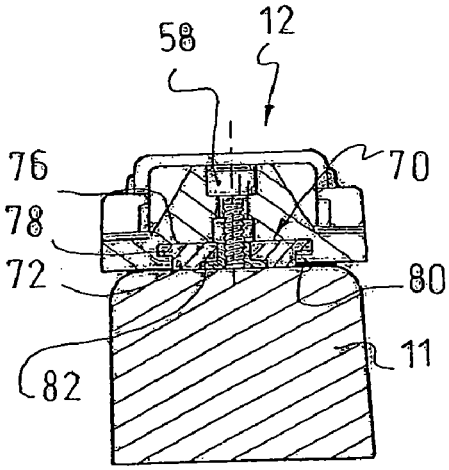

FIG. 12 shows that the binding device 12 has, on its lower surface, complementary rails 80 which, in this exemplary embodiment, extend substantially over the entire length of the binding device 12. As shown in FIGS. 15 and 16, the rails 80 have an L-shaped profile, such that the lower surface of the binding device 12 has a transverse shape that is complementary to the transverse shape of the slide 70. Thus, each of the rails 80 of the binding device 12 therefore has a transverse edge turned inward, which is to engage under the overhanging edges 78 of the slide 70. The transverse spacing between the two edges vis-à-vis the rails 80 is substantially equivalent to the width of the lower portion 72 of the slide 70. Similarly, the edges are spaced from the lower surface of the device by a distance substantially equivalent to the thickness of the upper portion 76 of the slide 70. If the slide 70 were to be made with a different profile, the lower surface of the binding device 12 would be modified accordingly. Stated another way, the slide 70 has engagement surfaces spaced above the upper surface 32 of the ski 11 and above engagement surfaces of the binding device 12.

Due to these complementary arrangements of the binding device 12 and slide 70, the device can be longitudinally slidably engaged on the slide 70 and, once entirely engaged, it can be blocked against movement therein in all directions but the longitudinal direction.

Figure 17:
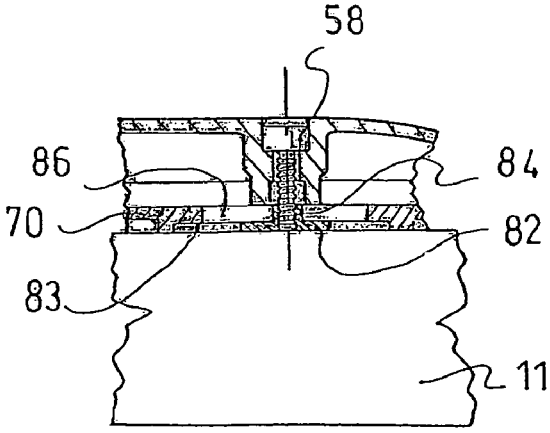
FIG. 17 is a detailed, longitudinal, cross-sectional view showing the tightening mechanism.

FIGS. 16 and 17 show a tightening mechanism that makes it possible to block the binding device longitudinally, on the one hand, and to force the device to take support against the ski upper surface, on the other hand.

In contrast with the first embodiment of the invention, the tightening mechanism ensures the longitudinal blocking of the device does not cooperate with the guiding/retaining mechanism that is formed by the transverse edges 70, 80 of the slide and of the device.

Indeed, the slide 70 has, in its lower portion, a housing 83 that extends longitudinally and receives a plate 82. The plate 82 has a threaded cylindrical shaft 84 that is oriented vertically upward and slides in an oblong slot 86 provided in the upper portion of the slide, so as to open out in the upper surface of the slide 70. The housing 83 and the slot 86 are arranged on the central longitudinal axis of symmetry of the slide 70. The plate 82 is engaged in its housing 83 before the slide is mounted on the ski. As seen with reference to the first embodiment, the binding device 12 bears a tightening screw 58 that can be screwed into the threaded cylindrical shaft 84. Before the tightening, it is possible to adjust the longitudinal position of the binding device 12 within the limit of movability of the plate 82 within its housing 83. Once the correct or desired position has been found, the screw 58 is turned until the device is tightened on the ski, a tightening which, as in the previous embodiment, blocks the device 12 longitudinally on the slide 70 and eliminates any vertical play between the device 12 and the ski-and-slide sub-assembly.

Figure 18:
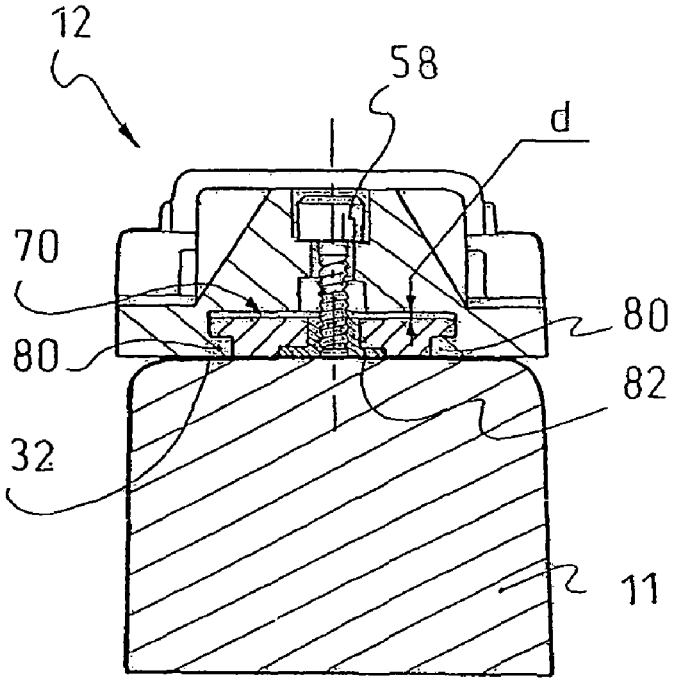
FIGS. 18 and 19 are enlarged schematic views showing the effects of the tightening mechanism of FIG. 17.
Figure 19:
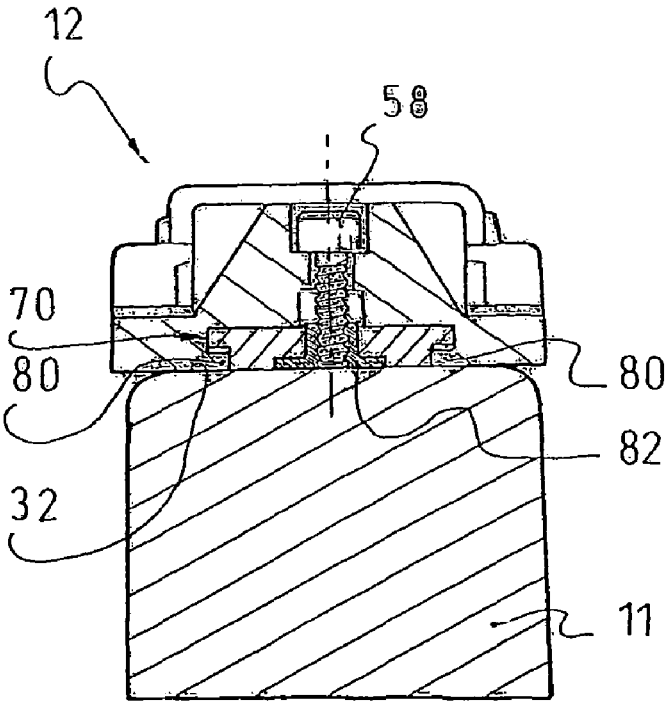

FIGS. 18 and 19 more specifically show how to ensure, when screwing the tightening mechanism constituted in this case by the screw 58 and the plate 82, that the rails 80 take support on the upper surface 32 of the ski (on both sides of the slide 70) before the lower surface of the device takes support against the upper surface of the slide 70. The principle is the same as that described in reference to the first embodiment of the invention.

Figure 20:
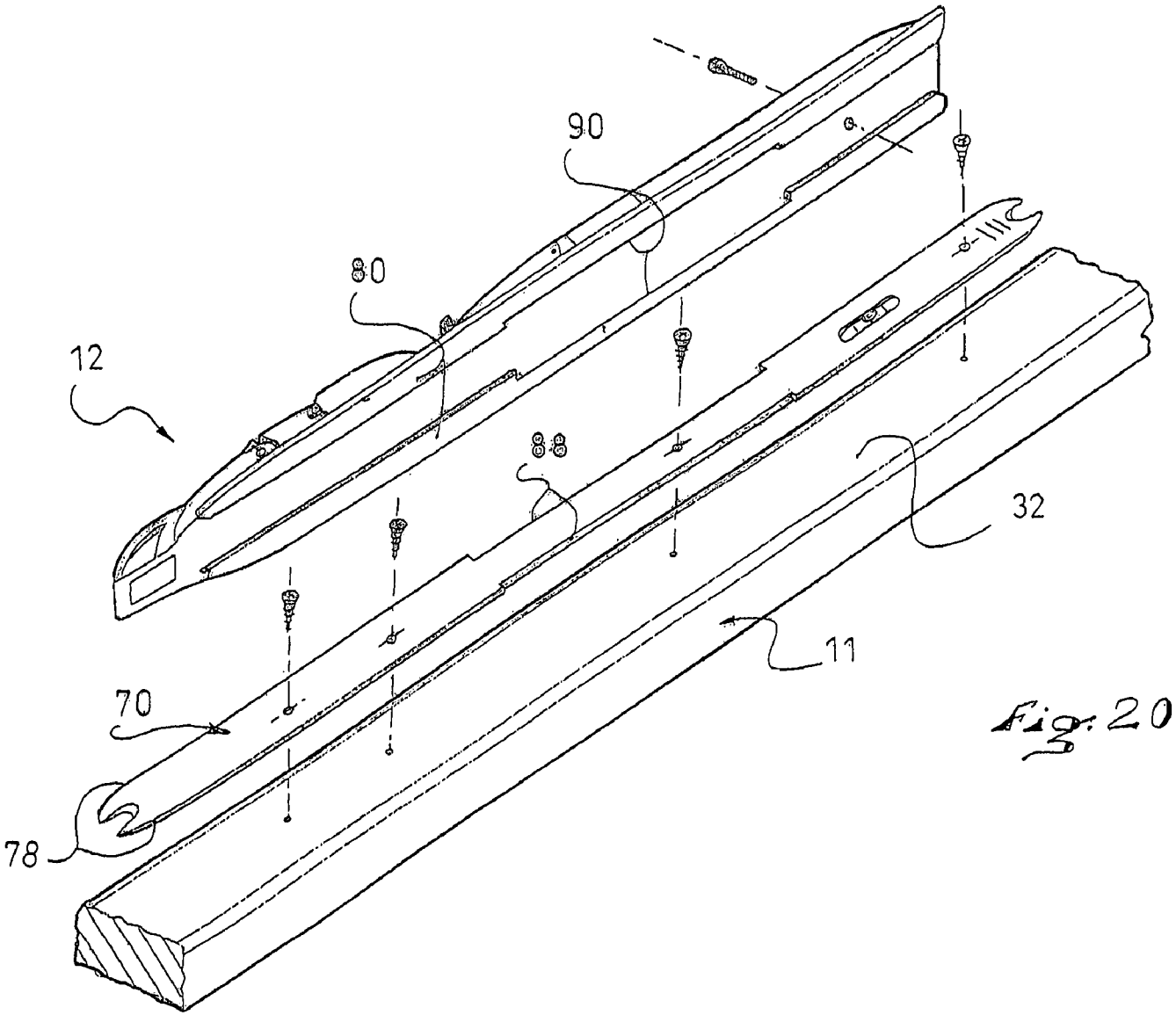
FIG. 20 is a view, similar to that of FIG. 1, showing an alternative to the second embodiment according to the invention.
Figure 21:
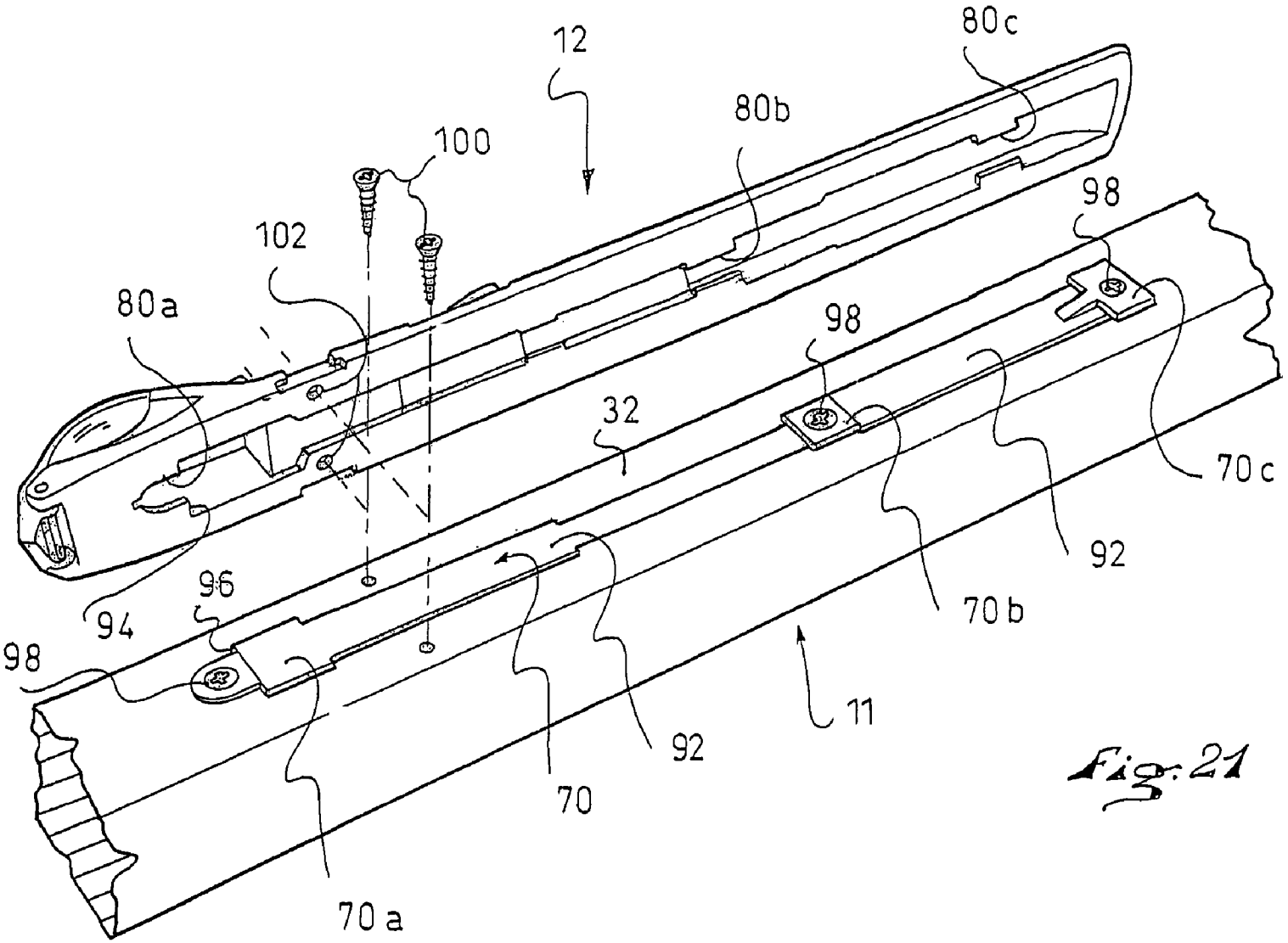
FIGS. 21 and 22 are views similar to those of FIGS. 1 and 2, showing a third embodiment according to the invention.
Figure 22:
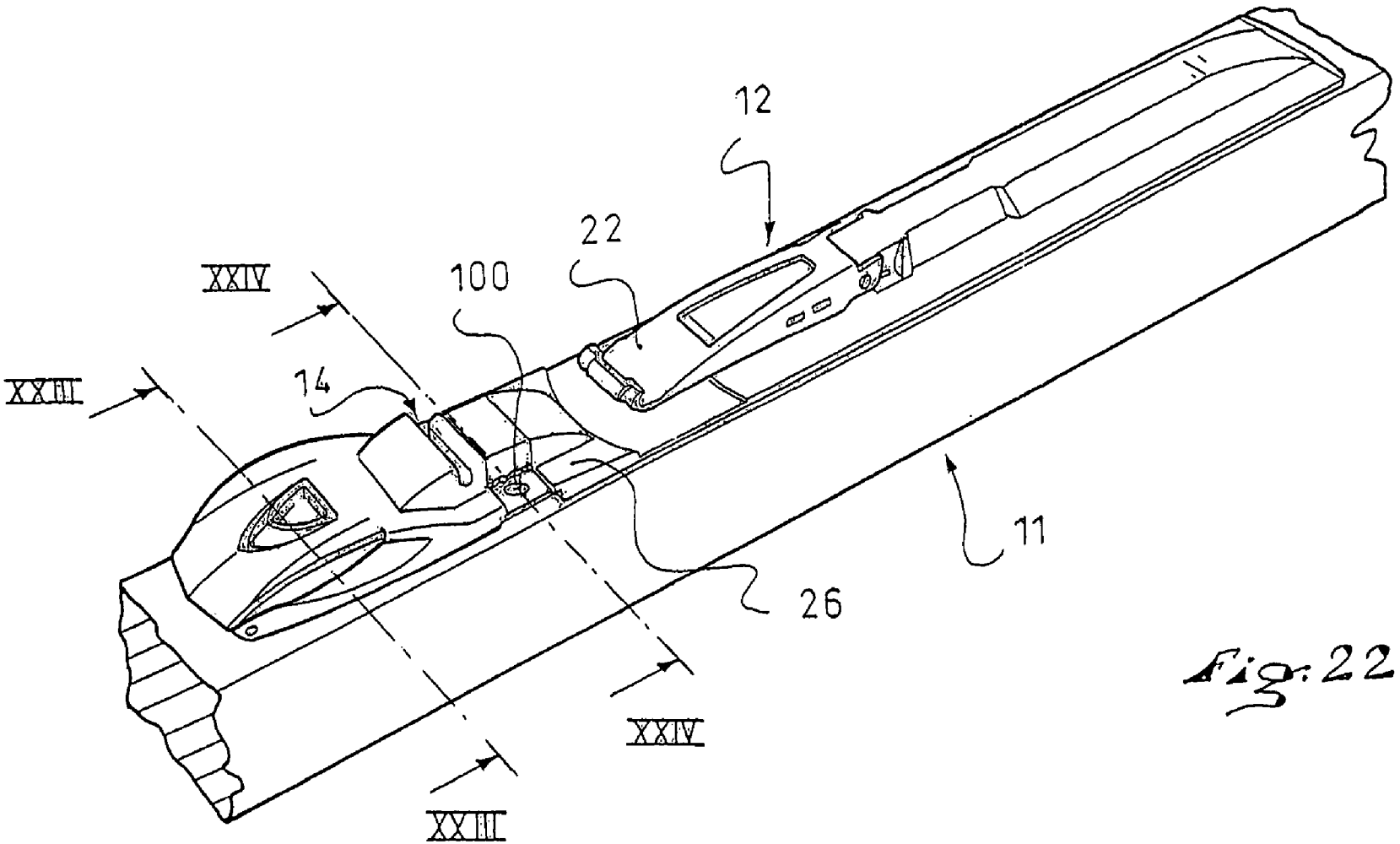

FIG. 20 shows an alternative for the second embodiment in which the edges of the rails 80 of the binding device 12, as well as the edges 78 of the slide 70, each have complementary notches 88, 90, which allow vertical engagement of the binding device on the slide 70 without having to slide it over its entire length to bring it into position. In this case, notches 88 of the slide 70 have a length at least equal to that of the unnotched front portion of the rails 80 of the device 12.

In the two embodiments just described, the tightening mechanism enables the longitudinal blocking of the binding device 12 in the corresponding slide 40, 70. This blocking is carried out by means of tightening, and therefore by friction. In this case, tightening is carried out between smooth surfaces, so that, over a certain adjustment range (which is defined, in the second embodiment, by the length of the housing 83 and/or that of the window 86), the blocking can be carried out in an infinite number of positions, continuously over this adjustment range, or in any position within a continuous adjustment range. The notches 88 of the slide in the embodiment illustrated in FIG. 20 then separate two active sections of the slide.

In addition, the tightening mechanism enables the functional clearances between the binding device and the ski to be minimized. Indeed, slide assemblies systematically create clearances, not only along the vertical direction, but also along the transverse direction. Indeed, in order to be able to slide the binding device on the slide, it is necessary to provide clearances, which is all the more important since it is also necessary to provide manufacturing clearances between the various elements. In the prior art, these clearances are not canceled. With use over time and the unavoidable wear and tear of the elements, these clearances as well as the interfering movements of the binding device with respect to the ski can only be amplified.

A tightening mechanism can eliminate such play and overcome their drawbacks.

Further, providing that tightening first bring the device 12 in support directly on the gliding apparatus rather than on the slide guarantees optimal stability by means of a maximum transverse spacing of the supports, on the one hand, and a direct transmission of the support forces exerted by the skier on the device toward the ski, without the slide having any filtering or damping effect.

In the two examples shown hereinabove, the slide is longitudinally made as a single piece, with a substantially constant cross section over its entire length. Alternatively, the slide can be made in two or more parts, such parts being either discrete or linked together by connecting portions not forming a slide, as for the alternative embodiment shown in FIG. 20. Alternatively, as will be seen with reference to the third embodiment of the invention, described hereinafter, the sections can be limited to point sliding elements, longitudinally aligned and arranged to correspond to anchoring elements of the binding device. Such embodiments have the advantage of being lighter. They also prevent any longitudinal stiffening effect of the ski, which could be due to having the slide on the upper surface of the ski. Conversely, the stiffness due to the slide could be a useful characteristic for the optimal functioning of the assembly 10. In this regard, the two previous embodiments provide for the slide to be entirely secured to the ski. However, if secured by means of screws, all but one of the screwing points can be provided to enable the slide to freely slide with respect to the ski. This type of assembly is well known in interface systems for alpine skis and limits the effects of stiffening the ski by means of the interface.

In the two examples previously shown, a first embodiment with a slide entirely integrated into the recess of a ski having a three-dimensional surface is first described, followed by an embodiment with a raised slide on a flat-surfaced ski. However, using a raised slide such as that of the second embodiment, combined with a ski having a recess such as shown in the first embodiment, can also be considered. It then suffices to adapt the configuration of the lower surface of the slide 70 to the shape of the recess. Conversely, for a given slide shape, the upper surface of the ski could have a recess with an adapted shape.

In the two embodiments shown, the tightening mechanism has a screw-nut mechanism. However, this tightening mechanism could be made in other forms, such as, for example, a quick cam tightening of a type well known in fastening bicycle wheels to the frame.

The third embodiment of the invention shown in FIGS. 21 to 24 uses the same general principles as the two first embodiments, but in a simplified version, without the possibility of lengthwise adjustment or without the entire anchoring of the binding device on the ski being carried out by the slide only.

As in the other embodiments, the binding assembly has a slide 70 fixed on the ski by means of screws 98, in this case, although any other arrangement to fasten the slide comes within the scope of the invention. In the example shown, the slide has in fact three active portions 70*a*, 70*b*, 70*c* spaced apart along the longitudinal direction and connected together by connecting portions 92. Each active portion 70*a*, 70*b*, 70*c* of the slide can be considered as a section of the slide. In this example, the ski is a flat ski and the slide is T-shaped as in the second embodiment described hereinabove. However, all of the alternative embodiments envisioned above are applicable. The body of the binding device has rail portions 80*a*, 80*b*, 80*c* that are complementary to the active portions 70*a*, 70*b*, 70*c*, these rail portions being spaced apart by portions that are similar to the notched portions 90 of the embodiment shown in FIG. 20. Further, as described with respect to foregoing embodiments, the slide 70 of the third embodiment has engagement surfaces that are spaced above the upper surface 32 of the ski 11 and above engagement surfaces of the binding device 12, i.e., above engagement surfaces of the rail portions 80*a*, 80*b*, 80*c* of the rail 80. The complementary anchoring active portions of the slide 70 and of the binding device 12 each have a relatively short length, for example on the order of 1 to 2 centimeters, and, in the particular embodiment shown, they are arranged in the vicinity of the front and rear ends, respectively, of the binding device, as well as in the vicinity of the center thereof. As in the embodiment shown in FIG. 20, they make it possible to engage the binding device vertically astride the slide, in a position offset forward, and then to cause the nesting of the rail portions 80*a*, 80*b*, 80*c* under the corresponding portions 70*a*, 70*b*, 70*c* of the slide by offsetting the binding device rearward. In this and other illustrated exemplary embodiments, the distance between the forwardmost and rearwardmost ends of the engagement surfaces of the binding device (such as the distance between the front end of front rail portion 80*a* and the rear end of the rear rail portion 80*c*) is at least as great as the distance between the front and rear ends of the slide.

As in the other embodiments, the cooperation of the active anchoring parts of the device and the slide allow the positioning of the binding device 12 along the vertical and transverse directions, but not along the longitudinal direction. In the example shown in FIG. 21, however, complementary abutment surface 94 on the binding device and abutment surface 96 on the slide have been provided to block the binding device 12 longitudinally with respect to the slide 70, but only in one direction, i.e., the rearward direction in this case. The function of the abutments 94, 96 is essentially to inform the skier that the binding device has been placed in the correct assembly position.

According to the particular aspect of this embodiment of the invention, the longitudinal blocking and the tightening of the binding device 12 on the upper surface 32 of the ski 11 are carried out with two screws 100, which extend through openings 102 of the main body 26 of the device, and which anchor themselves in the ski, and not on an element connected to the slide. As shown in FIG. 24, the heads of the tightening screws 100 take support on an upper surface of the main body 26 of the binding device 12, whereas the body of each of the tightening screws is positioned inwardly of the ski extends through one of the openings 102. Each one of the tightening screws 100 therefore carries out the same anchoring function as the screws conventionally used for directly mounting binding devices on a ski. The screws 100 are screwed directly into the structure of the ski, i.e., meaning across upper decorative and reinforcement layers and, possibly, the screws penetrate into the ski core. Alternatively, the screws could be screwed into inserts integrated into the ski (such as during the ski manufacturing), such inserts being independent of the slide. In both cases, the one or more tightening mechanisms directly cooperate with the ski, in contrast to the previously described embodiments in which the tightening mechanism(s) cooperates with the slide.

In the embodiment shown, there are two direct tightening screws 100 symmetrically arranged on opposite sides of the longitudinal plane of symmetry of the binding device 12. They are arranged, in this embodiment, in an area near the zone of the binding device 12, which takes most of the forces during use of the assembly. To do so, they are therefore arranged in the immediate vicinity of the area of the locking mechanism 14 where the boot is attached, and not far from the elastic return mechanism having the connecting member 22. The screws 100 can then be covered by a cover (not shown). When being turned, the screws 100 enable the binding structure 26 to be completely supported against a desired support zone of the upper surface 32 of the ski 11.

This binding assembly can be considered a hybrid in that the anchoring is provided in part by the slide and in part by a tightening mechanism that is independent of the slide, in contrast with the previous embodiments of the invention in which all of the anchoring mechanisms, including the tightening mechanisms, cooperate with the slide to anchor the device and to lay in flat in support on the ski.

With the hybrid assembly, the retaining and tightening of the device against the ski are the strongest, where the forces are concentrated, and highly reliable over time, the anchoring of the other portions of the device being carried out by the active portions of the slide, such as the active portions 70*a*, 70*b*, 70*c*. Thus, the hybrid assembly keeps at least part of the advantages of the assembly by means of a slide, which are a precise and reliable positioning of the binding device. However, a hybrid assembly of the type just described could be provided, with a mechanism for direct tightening on the ski, such as the screws 100, completed by a tightening mechanism borrowed from one of the two aforementioned first embodiments, where the tightening mechanism cooperates with the slide.

In the exemplary embodiment of a hybrid assembly, only one relative position of the device with respect to the slide (and therefore with respect to the ski) has been provided, especially due to the fact that the slide is divided into several small-size active portions along the longitudinal direction. By increasing the length of these active portions or by using a continuous slide as in the two first embodiments above, the possibility is preserved, at the time the binding device is assembled, to choose the exact position of the device, at least in a certain range. The final position would be determined after the tightening screws 100 are screwed in.

Furthermore, in the context of a hybrid assembly, the tightening screws 100 could be replaced by other tightening elements or mechanisms. Quick-tightening mechanisms using, for example, mechanisms referred to as "quarter turns" or cam mechanisms, can be considered. In the above-mentioned case in which the tightening mechanisms are anchored in inserts embedded in the ski, the inserts can be provided to allow several positions for adjusting the tightening elements/mechanisms in the form, for example, of several distinct locations, or of a lengthened location allowing for an adjustment within a continuous range.

The invention claimed is:

1. A ski assembly comprising:

a ski having an upper surface adapted to receive a binding device to retain a boot on the ski, the ski extending in a longitudinal direction;

a binding assembly comprising:

a binding device to retain at least a front end of a boot against detachment from the ski;

an anchoring device for anchoring the binding device to the ski, said anchoring device comprising:

a slide;

at least one tightening mechanism for enabling a flattening of a lower part of the binding device directly against the upper surface of the ski;

the at least one tightening mechanism comprising a blocking arrangement to longitudinally block the binding device in position relative to the slide.

2. An assembly according to claim 1, wherein:

the slide is arranged at a transverse center of the ski.

3. An assembly according to claim 1, wherein:

the slide has a width smaller than a width of the ski.

4. An assembly according to claim 1, wherein:

a support zone is arranged transversely on each of a pair of opposite sides of the slide, the slide constituting a central slide.

5. An assembly according to claim 1, wherein:

the slide is arranged so that, when the tightening is completed, the binding device is also supported on the slide.

6. An assembly according to claim 1, wherein:

the slide is arranged in a recess of the upper surface of the ski.

7. An assembly according to claim 6, wherein:

the slide is arranged in the recess so as to be flush with the upper surface of the ski.

8. An assembly according to claim 1, wherein:

the slide has engagement surfaces spaced from the upper surface of the ski and above engagement surfaces of the binding device.

9. An assembly according to claim 1, wherein:

the binding device further comprises at least one longitudinal guide configured and arranged to cooperate with the slide to enable the binding device to be positioned on the upper surface of the ski.

10. An assembly according to claim 1, wherein:

the blocking arrangement is configured and arranged to block the binding device in any position within a continuous longitudinal adjustment range along the slide.

11. An assembly according to claim 1, wherein:

the slide comprises an element having a uniform cross-sectional dimension along a length of said element.

12. An assembly according to claim 11, wherein:

said element of the slide comprises at least two parts.

13. An assembly according to claim 12, wherein:

the two parts the element of the slide are connected to one another.

14. An assembly according to claim 12, wherein:

the two parts of the element of the slide are disjoined.

15. An assembly according to claim 1, wherein:

the slide comprises a lower surface having a shape complementary to a shape of the upper surface of the ski.

16. An assembly according to claim 1, wherein:

the tightening mechanism comprises at least one screw/nut combination, said screw/nut combination cooperating with the slide to be movable only along a longitudinal direction;

the binding device is connected to the screw/nut combination by means of a tightening screw.

17. An assembly according to claim 1, wherein:

the at least one tightening mechanism includes at least one tightening mechanism in direct cooperation with the ski.

18. An assembly according to claim 17, wherein:

the at least one tightening mechanism in direct cooperation with the ski comprises at least one screw screwed into the ski.

19. An assembly according to claim 17, wherein:

the at least one tightening mechanism in direct cooperation with the ski comprises an insert integrated into the ski.

20. An assembly according to claim 1, wherein:

the at least one tightening mechanism is arranged in an area of a zone for locking the boot onto the binding device.

21. An assembly according to claim 1, wherein:

the at least one tightening means comprises a cam device.

22. An assembly according to claim 1, wherein:

the at least one tightening mechanism is configured and arranged to flatten the lower part of the binding device in engagement with the upper surface of the ski.

23. An assembly according to claim 1, wherein:

the binding device is a cross-country ski binding configured and arranged to secure a front end of the boot against detachment from the ski during use of the binding device, and to allow a rear of the boot to be moved alternately away from and toward the ski during cross-country skiing.

24. An assembly according to claim 23, wherein:

the binding device further comprises a longitudinal guide rib to project from the upper surface of the ski to be received in a longitudinal recess in a sole of the boot during movement of the boot during cross-country skiing.

25. A ski assembly according to claim 1, wherein:

the lower part of the binding device, when anchored to the ski, transversely straddles the slide.

26. An assembly according to claim 1, wherein:

the slide has a maximum width of about 26 mm.

27. An assembly according to claim 1, wherein:

the binding device has a maximum width approximately equal to a width of an upper surface of the ski.

28. An assembly according to claim 1, wherein:

the slide and the binding device have respective complementary abutment surfaces to block the binding device longitudinally with respect to the slide in a single correct assembly position, the binding device having no possibility of lengthwise fixed adjustment from said single correct assembly position.

29. An assembly according to claim 1, wherein:
the binding device has engagement surfaces for engagement with surfaces of at least one active section of the slide.

30. An assembly according to claim 29, wherein:
a distance between forwardmost and rearward most ends of the engagement surfaces of the binding device is at least as great as a distance between a front end and a rear end of the slide.

31. An assembly according to claim 1, wherein:
the slide is structured and arranged to enable the binding device to be secured in position transversely relative to the longitudinal direction of the ski and vertically relative to the upper surface of the ski.

32. An assembly according to claim 1, wherein:
the binding device includes a guide surface slidably engageable with a surface of said slide;
the binding device further includes a surface directly engageable with the upper surface of the ski when the binding device is anchored to the ski.

33. An assembly according to claim 1, wherein:
the binding device includes a locking mechanism to lock the boot to the binding device;
the binding device, including the locking mechanism, being movably mounted along the slide of the anchoring during a longitudinal movement and positioning of the binding device along the ski to an anchored position on the ski.

34. An assembly according to claim 1, wherein:
the binding device comprises:
a base comprising a boot support surface and a surface directly engaged on the upper surface of the ski;
a locking mechanism to lock the boot to the binding device mounted on the base.

35. An assembly according to claim 34, wherein:
the blocking arrangement comprises a screw extending through the base and into the ski.

36. A ski assembly comprising:
a ski having an upper surface adapted to receive a binding device to retain a boot on the ski;
a binding assembly comprising:
a binding device to retain at least a front end of a boot against detachment from the ski;
an anchoring device for anchoring the binding device to the ski, said anchoring device comprising:
a slide fixed in position on the upper surface of the ski;
at least one tightening mechanism for enabling a flattening of a lower part of the binding device against the upper surface of the ski and for fixing the lower part of the binding device against movement relative to the slide.

37. An assembly according to claim 36, wherein:
the slide is integrated with the ski upper surface, said slide having been fixed to the ski upper surface during manufacture of the ski.

38. An assembly according to claim 36, wherein:
the slide is fixed onto the ski to the ski after manufacture of the ski.

39. An assembly according to claim 38, wherein:
the slide is fixed to the ski with glue or welds.

40. An assembly according to claim 38, wherein:
the slide is fixed to the ski with screws.

41. A ski assembly according to claim 36, wherein:
the lower part of the binding device, when anchored to the ski, is directly engaged against the upper surface of the ski.

42. A ski assembly according to claim 36, wherein:
the lower part of the binding device, when anchored to the ski, transversely straddles the slide.

43. A ski assembly according to claim 36, wherein:
the slide has a maximum width of about 26 mm.

44. An assembly according to claim 36, wherein:
the binding device has a maximum width approximately equal to a width of an upper surface of the ski.

45. An assembly according to claim 36, wherein:
the binding device includes a guide surface slidably engageable with a surface of said slide;
the binding device further includes a surface directly engageable with the upper surface of the ski when the binding device is anchored to the ski.

46. An assembly according to claim 36, wherein:
the binding device includes a locking mechanism to lock the boot to the binding device;
the binding device, including the locking mechanism, being movably mounted along the slide of the anchoring during a longitudinal movement and positioning of the binding device along the ski to an anchored position on the ski.

47. An assembly according to claim 36, wherein:
the binding device comprises:
a base comprising a boot support surface and a surface directly engaged on the upper surface of the ski;
a locking mechanism to lock the boot to the binding device mounted on the base.

48. An assembly according to claim 47, wherein:
the blocking arrangement comprises a screw extending through the base and into the ski.

49. A binding assembly for securing at least a front end of an article of footwear against detachment from an upper surface of a sports apparatus, said binding assembly comprising:
a binding device;
an anchoring device comprising:
a slide;
at least one tightening mechanism for enabling a flattening of a lower part of the binding device against the upper surface of the sports apparatus;
the at least one tightening mechanism comprising a blocking arrangement to longitudinally block the binding device in position relative to the slide.

50. A binding assembly according to claim 49, wherein:
the at least one tightening mechanism is configured and arranged to flatten the lower part of the binding device in engagement with the upper surface of the sports apparatus.

51. A binding assembly according to claim 49, wherein:
the binding device is a cross-country ski binding configured and arranged to secure a front end of the boot against detachment from the ski during cross-country skiing, and to allow a rear of the boot to be moved alternately away from and toward the ski during said cross-country skiing.

52. A binding assembly according to claim 51, further comprising:
a longitudinal guide rib projecting from the upper surface of the ski to be received in a longitudinal recess in a sole of the boot during movement of the boot.

53. A binding assembly according to claim 49, wherein:
the slide has a maximum width of about 26 mm.

54. A binding assembly according to claim 49, wherein:
the blocking arrangement comprises a plurality of connectors structured and arranged to extend from the binding device to the sports apparatus.

55. A binding assembly according to claim 49, further comprising:

a plurality of holes in the binding device;

the blocking arrangement further comprising a plurality of screws structured and arranged to extend through said plurality of holes and into the sports apparatus.

56. A binding assembly according to claim 49, wherein:

the lower part of the binding device is structured and arranged to transversely straddle the slide.

57. A binding assembly according to claim 49, wherein:

the binding device includes a guide surface slidably engageable with a surface of said slide;

the binding device further includes a surface directly engageable with the upper surface of the sports apparatus when the binding device is anchored to the sports apparatus.

58. A binding assembly according to claim 49, wherein:

the binding device includes a locking mechanism to lock the article of footwear to the binding device;

the binding device, including the locking mechanism, being movably mounted along the slide of the anchoring during a longitudinal movement and positioning of the binding device along the sports apparatus to an anchored position on the sports apparatus.

59. A binding assembly according to claim 49, wherein:

the binding device comprises:

a base comprising a boot support surface and a surface structured and arranged to be directly engaged on the upper surface of the sports apparatus;

a locking mechanism to lock the article of footwear to the binding device mounted on the base.

60. A binding assembly according to claim 59, wherein:

the blocking arrangement comprises a screw extending through the base and into the sports apparatus.

* * * * *